US007081703B2

(12) United States Patent
Chen et al.

(10) Patent No.: US 7,081,703 B2
(45) Date of Patent: Jul. 25, 2006

(54) TETRAODE FIELD-EMISSION DISPLAY AND METHOD OF FABRICATING THE SAME

(75) Inventors: Kuo-Rong Chen, Taoyuan (TW); Jin-Shou Fang, Taoyuan (TW); Kuei-Wen Cheng, Taoyuan (TW)

(73) Assignee: Teco Nanotech Co., Ltd., Taoyuan (TW)

( * ) Notice: Subject to any disclaimer, the term of this patent is extended or adjusted under 35 U.S.C. 154(b) by 115 days.

(21) Appl. No.: 10/827,275

(22) Filed: Apr. 20, 2004

(65) Prior Publication Data

US 2005/0231098 A1 Oct. 20, 2005

(51) Int. Cl.
*H01J 1/62* (2006.01)
*H01J 63/04* (2006.01)

(52) U.S. Cl. ..... 313/495; 313/496; 313/336

(58) Field of Classification Search ..... 313/495–497, 313/292, 309, 336, 351
See application file for complete search history.

(56) References Cited

U.S. PATENT DOCUMENTS 5,955,833 A * 9/1999 Janning ..... 313/495
6,617,798 B1 * 9/2003 Lee et al. ..... 315/169.3

FOREIGN PATENT DOCUMENTS

TW 502395 9/2002

* cited by examiner

*Primary Examiner*—Karabi Guharay
*Assistant Examiner*—Kevin Quarterman

(57) ABSTRACT

A tetraode field-emission display and a method of fabricating the same are disclosed. A mesh is disposed between an anode plate and a cathode plate. The mesh has a gate layer and a converging electrode layer separated by an insulation layer to form a sandwich structure. The mesh has a plurality of apertures in correspondence with each set of anode and cathode. A glass plate is placed between the mesh and the anode to serve as a spacer. The converging electrode layer is facing the anode plate, such that the divergent range of an electron beam emitted by an electron emission source can be restricted. Thereby, the electron beam can impinge the corresponding anode more precisely.

17 Claims, 7 Drawing Sheets

TETRAODE FIELD-EMISSION DISPLAY AND METHOD OF FABRICATING THE SAME

BACKGROUND OF THE INVENTION

The present invention relates in general to a field-emission display and a method of fabricating the same, and more particular, to a method and a structure that introduce a fourth electrode (converging electrode) to a conventional triode field-emission display.

Flat panel displays such as field-emission display (FED), liquid crystal display (LCD), plasma display panel (PDP) and organic light emitting diode display (OLED) have become more and more popular in the market. Lighter and thin are the common features of flat panel displays. According to specific characteristics such as dimension and brightness, some of the above are suitable for small dimension display panel such as cellular phone and personal data assistant (PDA), some are suitable for medium or large size display such as the computer and television screens, or some are even suitable for ultra-large size display such as the outdoor display panel. The development trend of various displays is to obtain high image quality, large display area, low cost and long life time.

The field-emission display is a very newly developed technology. Being self-illuminant, such type of display does not require a back light source like the liquid crystal display. In addition to the better brightness, the viewing angle is broader, power consumption is lower, response speed is faster (no residual image), and the operation temperature range is larger. The image quality of the field-emission display is similar to that of the conventional cathode ray tube (CRT) display, while the dimension of the field-emission display is much thinner and lighter compared to the cathode ray tube display. Therefore, it is foreseeable that the field-emission display may replace the liquid crystal display in the market. Further, the fast growing nanotechnology enables nano-material to be applied in the field-emission display, such that the technology of field-emission display will be commercially available.

FIG. 1 shows a conventional triode field-emission display, which includes an anode plate 10 and a cathode plate 20. A spacer 14 is placed in the vacuum region between the anode plate 10 and the cathode plate 20 to provide isolation and support thereof. The anode plate 10 includes an anode substrate 11, an anode conductive layer 12 and a phosphor layer 13. The cathode plate 20 includes a cathode substrate 21, a cathode conductive layer 22, an electron emission layer 23, a dielectric layer 24 and a gate layer 25. A potential difference is provided to the gate layer 25 to induce electron beam emission from the electron emission layer 23. The high voltage provided by the anode conductive layer 12 accelerates the electron beam with sufficient momentum to impinge the phosphors layer 13 of the anode plate 10, which is then excited to emit a light. To allow electron moving in the field-emission display, the vacuum is maintained at least under $10^{-5}$ torr, such that a proper mean free path of the electron is obtained. In addition, contamination and poison of the electron emission source and the phosphors layer have to be avoided. Further, the electron emission layer 23 and the phosphors layer 13 have to be spaced from each other by a predetermined distance for accelerating the electron with the energy required to generate light from the phosphors layer 13.

The conventional electron emission layer is typically in the form of a spike structure (as shown in FIG. 1) or a Spindt type structure. The latter structure includes a spike structure formed by thin-film process or photolithography process. By further development of thin-film process, various Spindt type field-emission display has been proposed and improved. The electron beam induced by electric field at the spike normally propagates in a curve with a small radius. Control electrodes in various configurations are introduced in the conventional field-emission display to correct the cross section of the electron beam or to guide the electron beam along the correct path to impinge the phosphors at the correct position. Therefore, the conventional field-emission display requires the spike structure of the electron emission source, the electron configurations, and the process of thin-film, photolithography or micro-electro-machining. These requirements hinder the development of field-emission display since sixties.

Recently, a carbon nanotube has been proposed by Iijima. Having high aspect ratio, high machine strength, high chemical resistance, abrasion resistance, low threshold electric field, the carbon nanotube has been popularly studied and applied as an electron emission source. As known in the art, the field electron emission is facilitated by applying a high electric field to a surface of a material to reduce the thickness of energy barrier of the material, such that electron can be ejected from the surface of the material to become a free electron according to quantum-mechanical tunneling effect. The current of the field electron emission can be increased by reducing the work function of the material surface. As the free electron is generated by the electric field, a heat source is not required, and the field electron emission apparatus is sometimes referred as a cold cathode.

The carbon nanotube has been continuously improved and applied to continuously enhance electron emission of a field-emission display. Currently, the carbon nanotube can be fabricated by a thick-film process (such as screen printing or spray printing). Referring to Chinese (Taiwanese) Patent Publication No. 502495, the carbon nanotube can be directly patterned on the cathode conductive layer 22 to form the electron emission layer 23 thereon. Thereby, the conventional triode field-emission display is not limited to the high-cost thin-film process. The carbon nanotube electron emission source provides a high electron emission efficiency (with a current density of 10 $\mu A/cm^2$ and a threshold voltage of 1.5 V/μm, and a current density of 10 $mA/cm^2$ under an electric field of 2.5 V/μm) which achieves perfect dynamic display effect with a lost cost driving circuit. Even so, each electron emission source unit is constructed of a plurality of carbon nanotubes, such that the electron beam generated thereby within the distance between the anode and the cathode is similar to that generated by the spike field-emission source. Therefore, the cross section of the collected electron beam 26 diverges while approaching the anode as shown in FIG. 2. The longer the distance is, the larger the cross section of the electron beam 26 is. It is possible that the cross section is larger than the luminescent area of the phosphors layer 13, or the diffused electron beam 26 might impinge the neighboring phosphors layer 13 to affect the color purity or image resolution.

To resolve the color purity or image resolution issue, the area of the electron emission source is reduced or partitioned into a plurality of smaller units, such that the electron beam 26 generated thereby is similar to the area of the corresponding phosphors layer 13 excited thereby. However, the reduction in cross section results in a lower efficiency of electron emission or reduced unit area of the corresponding phosphors layer 13, such that the space between neighboring phosphors layer 13 is increased, and the image resolution is degraded.

Another method to resolve the issue is to provide an adjustable voltage between the gate electrode 25 and the cathode conductive layer 22. In addition to electron drainage, the gate layer 25 can also control the cross section of the electron beam by adjusting the voltage. This type of design results in a lower efficiency of electron generation and a more complex circuit design. Further, the response time of the picture is increased, and the image quality is lowered.

The third method to resolve the above issue includes forming one or more than one set of control electrode between the cathode and the anode. The control gate provides a converging voltage or bias voltage to confine the cross section of the electron beam or deflect the electron beam, such that the electron beam can impinge the phosphors layer 13 at the predetermined position. However, such type of design requires complex fabrication process such as thin-film and lithography process and cannot meet with the requirement of large area display and mass production.

On the other hand, the vacuum space between the cathode plate 20 and the anode plate 10 of the conventional triode field-emission display is supported by a single spacer 14 or a rib. As the cathode and anode plate 20 and 10 are under a very low pressure vacuum condition, the spacer 14 is in the form of glass ball, cross glass plate or other solid strips to prevent the cathode and anode plates 20 and 10 tumbling down. Adhesion is used to attach the spacer 14 is attached to the cathode plate 20 and the anode plate 10, and a sintering process is performed to further secure the spacer 14 to the cathode plate 20 and the anode plate 10. To avoid affecting the displayed image, the spacer 14 is about 50μ to about 200 μm. This type of spacer 14 has the fabrication difficulty as follows:

1. Complicated fabrication process: As the spacer 14 is formed very thin, the precision requirement of attaching and transporting equipment for installing the spacer is higher.

2. The adhesion applied to the spacer easily causes contamination: As the conventional spacer 14 is dipped with adhesion paste and subjected to a heating process, the adhesion paste becomes a contamination source during the heating process. Further, the solvent of the adhesion paste may be evaporated in the sintering process to cause secondary contamination.

In addition, in the electric field operation, the surface of the spacer 14 is easily to accumulate charges to form an electric field around, such that the path and impinging effect of the electron beam upon the phosphor layer 13 will be affected.

BRIEF SUMMARY OF THE INVENTION

The present invention provides tetraode field-emission display and a method of fabricating the same. By disposing a gate layer and a converging electrode layer between an anode and a cathode, a tetraode structure is formed. The installation of the fourth electrode, that is, the converging electrode layer, the diverging range of the electron beam is effectively restricted. The cross section of the electron beam is thus effectively reduced to impinge on the phosphor layer at a predetermined location precisely without affecting the picture brightness, resolution and color purity. Further, the fabrication cost will not be increased.

The present invention also provides a tetraode field-emission display which includes a converging electrode layer formed by metal conductive plate and a gate electrode. The gate electrode and the converging electrode are disposed at two sides of the metal conductive layer to form a sandwich structure of mesh. The mesh can be fabricated by independent process and package with the anode plate in subsequent process. Therefore, the high cost of photolithography process and large thickness of the conventional structure are no longer required.

The present invention further provides a tetraode field-emission display and a method of fabricating the same. The fabrication process is much simpler, and such type of display can be fabricated by mass production.

The present invention further provides a tetraode field-emission display and a method of fabricating the same. The multiple spacers are replaced by a glass plate between the mesh and the anode plate, such that charges will not be accumulated around the spacer to cause undesired electric field. The electron beam can thus impinge on the phosphor layer at predetermined position precisely.

The tetraode field-emission display provided by the present invention includes a mesh between an anode plate and a cathode plate. The mesh includes a sandwich structure of a gate layer and a converging electrode player formed on two opposing sides of an insulation layer. The mesh includes a plurality of apertures extending therethrough. Each of the apertures corresponds to a set of anode unit and cathode unit. The converging electrode layer of the mesh is facing the anode plate, such that the divergent range of the electron beam emitted by the electron emission source is restricted thereby. The display further comprises a spacing glass plate between the anode plate and the converging electrode layer to serve as a support.

BRIEF DESCRIPTION OF THE DRAWINGS

These as well as other features of the present invention will become more apparent upon reference to the drawings therein.

DETAILED DESCRIPTION OF THE INVENTION

Figure 1:
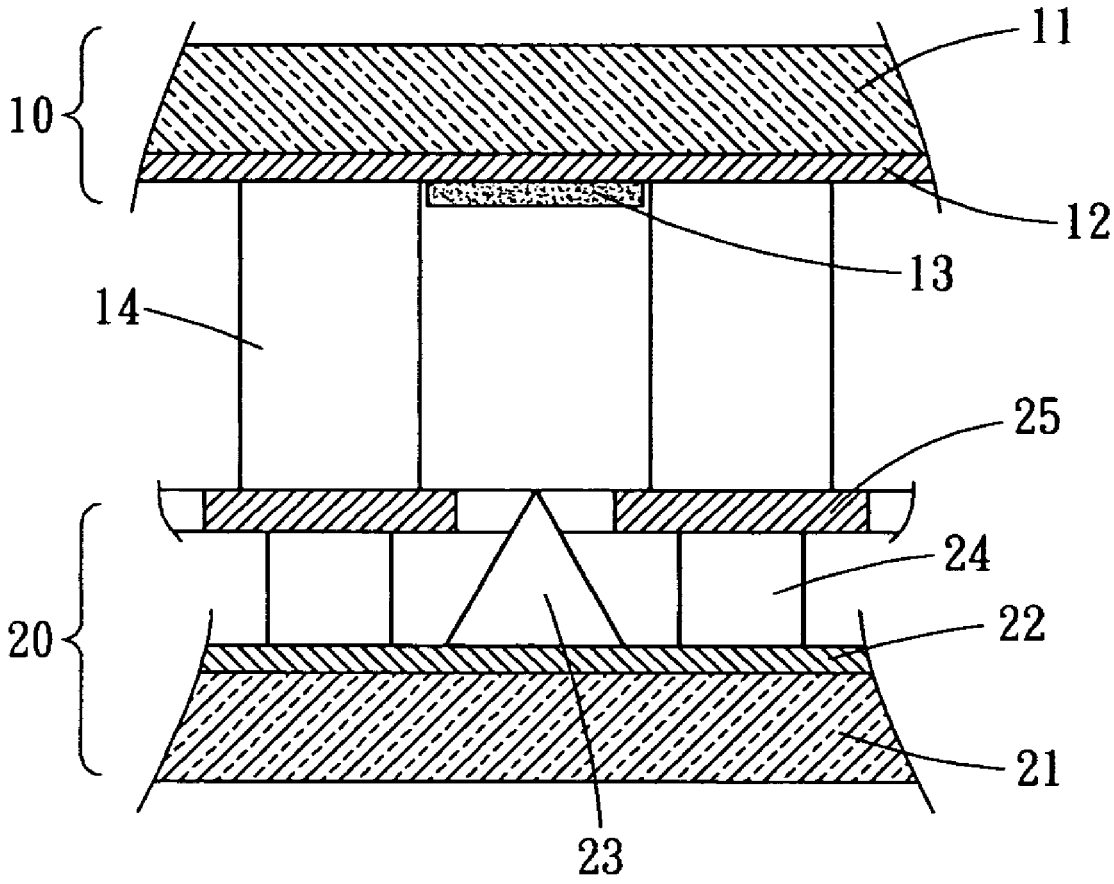
FIG. 1 PRIOR ART
FIG. 1 illustrates a cross sectional view of a conventional triode field-emission display.
Figure 2:
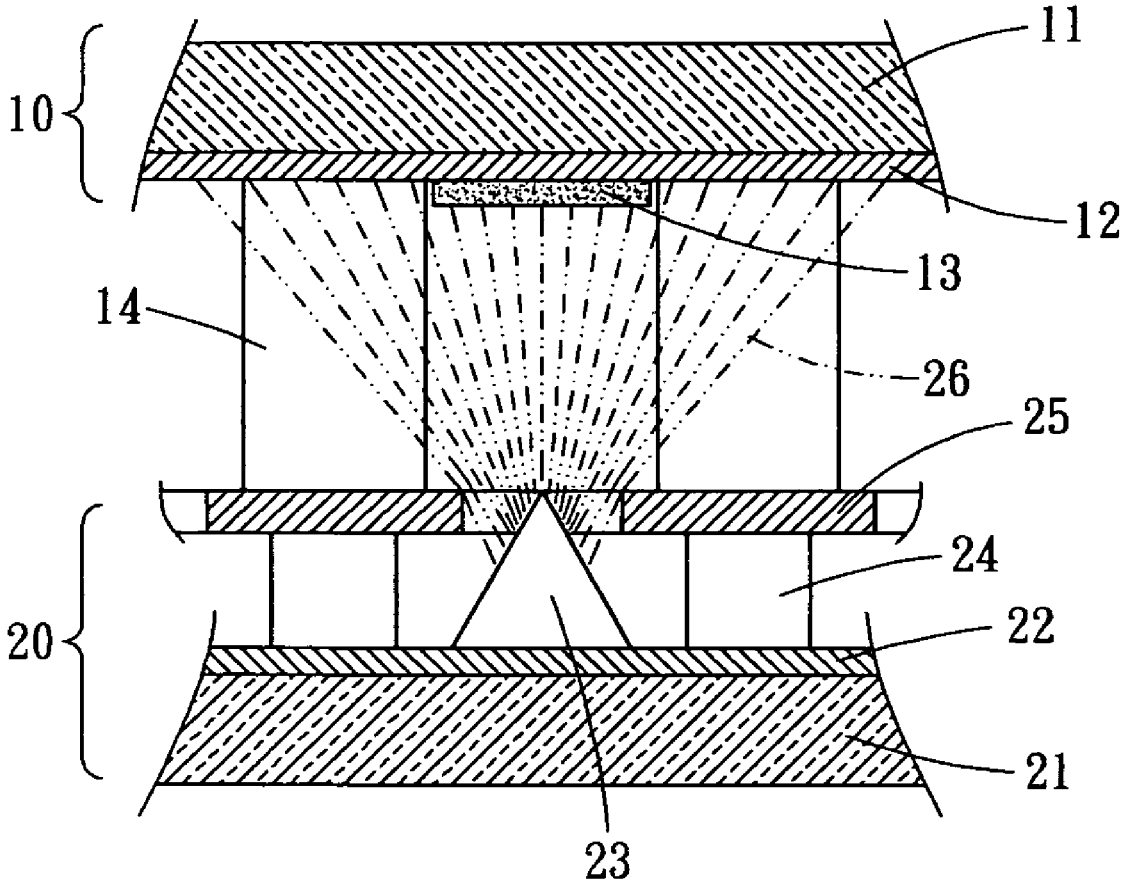
FIG. 2 PRIOR ART
FIG. 2 shows the emission path of an electron beam generated in the conventional triode field-emission display as shown in FIG. 1.
Figure 3:
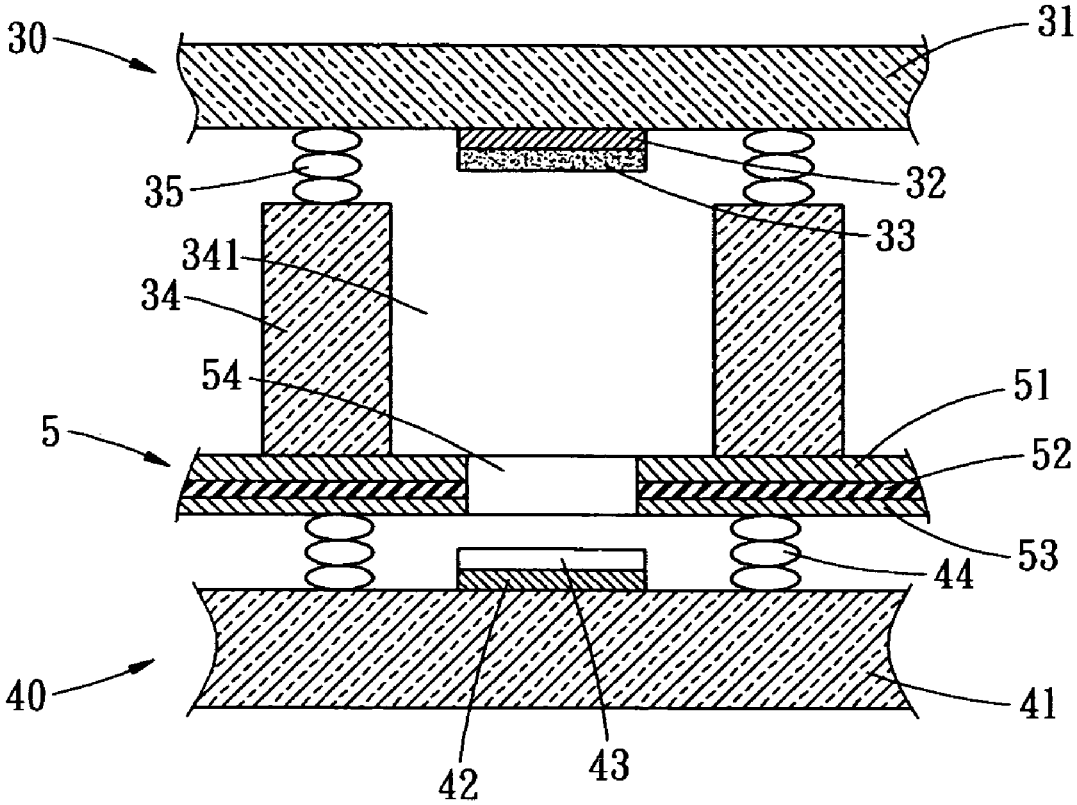
FIG. 3 shows a cross sectional view of a field-emission display provided by the present invention.

Referring to FIG. 3, a set of a cathode unit and an anode unit is illustrated. Each anode unit of the cathode plate 30 includes an anode conductive layer 32 and a phosphor layer 33 attached thereon. The anode conductive layer 32 is fanned on an anode substrate 31. The cathode plate 30 includes a cathode 41, and each cathode unit includes a cathode conductive layer 42 formed on the cathode substrate 41 and an electron emission source layer 43 attached on the cathode conductive layer 42. A mesh 5 is disposed between the cathode plate 40 and the anode plate 30. The mesh 5 includes a converging electrode layer 51, an insulation layer 52 and a gate layer 53 stacked together. The converging electrode layer 51 is facing the anode plate 30, while the gate layer 53 is facing the cathode plate 40. Each of the gate layer 53 and the converging electrode layer 51 is connected to a specific potential. The mesh 5 includes a plurality of apertures 54 aligned with the corresponding set of anode and cathode units, such that electron eniltind turn the electron emission source layer 43 can propagate through the aperture 54 towards the phosphor layer 33.

Figure 4:
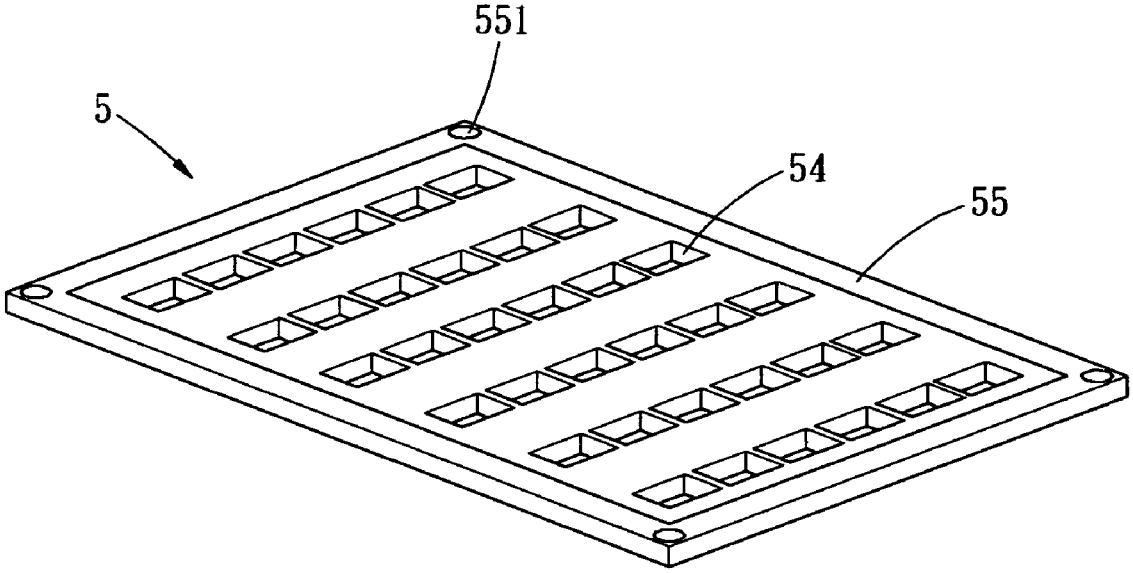
FIG. 4 shows the structure of a mesh of the field-emission display as shown in FIG. 3.
Figure 5:
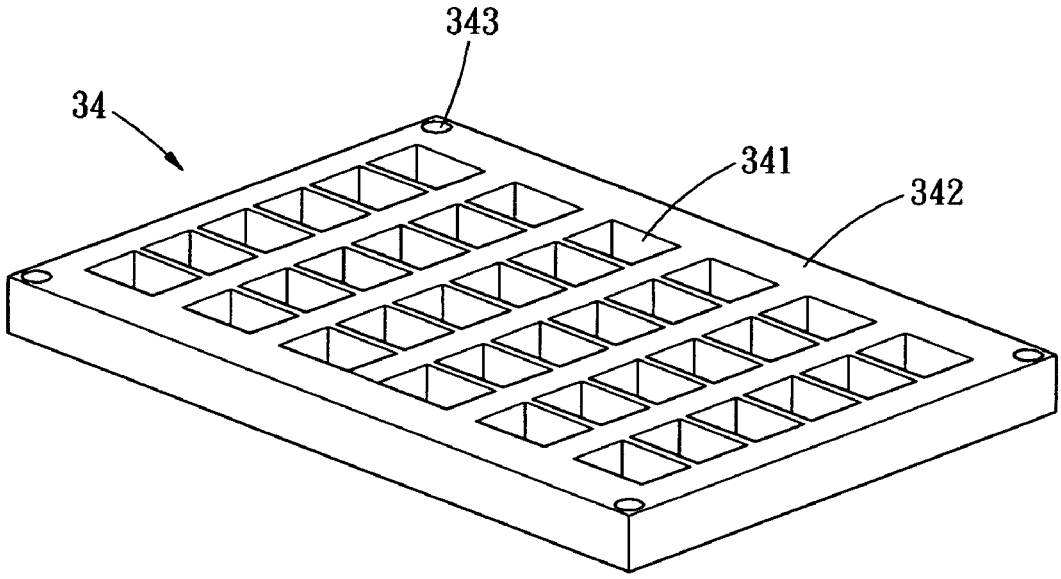
FIG. 5 shows a preferred embodiment of a spacing glass plate applied to the field-emission display as shown in FIG. 3.
Figure 6:
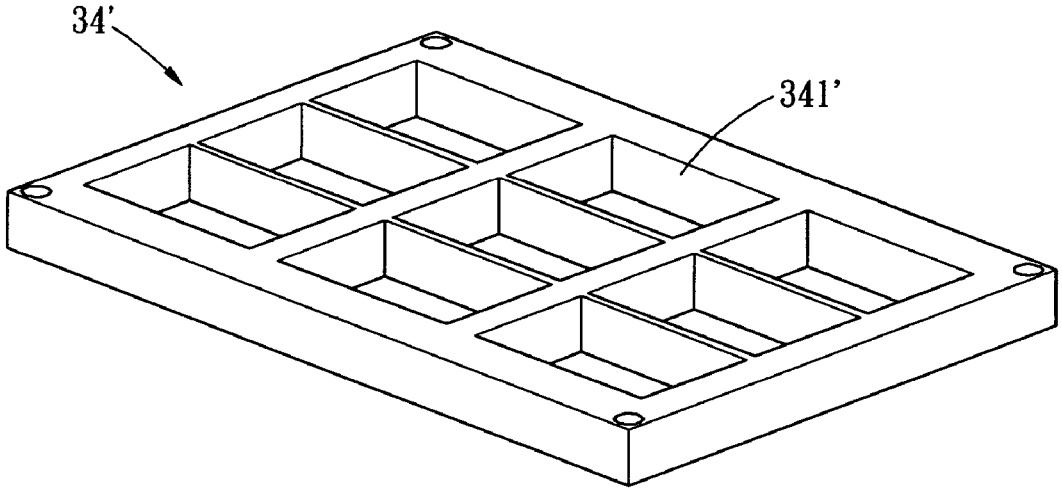
FIG. 6 shows another embodiment of the spacing glass plate.

FIG. 4 illustrates a perspective view of the mesh 5. The mesh 5 includes the insulation layer 52 sandwiched by the converging electrode layer 51 and the gate layer 53. Preferably, the converging electrode layer 51 is fabricated from a metal conductive plate formed on one side of the insulation layer 52, and the gate layer 53 is fabricated from a conductive layer formed on the other side of the insulation layer 52. The apertures 54 are formed in an array extending through the converging electrode layer 51, the insulation layer 52 and the gate layer 53. In this embodiment, rectangular apertures 54 are formed to be aligned with the corresponding sets of anode and cathode units. The apertures 54 allow the electrons emitted from the cathode units to project to the corresponding anode units. The periphery of the mesh 5 includes an invalid region 55. A plurality of markings 551 can be formed on the invalid region 55 for alignment during vacuum package process or the alignment between the apertures 54 and the corresponding set of anode and cathode units.

The field-emission display further comprises a spacing glass plate 34 extending between the anode plate 10 and the mesh 5. The material for fabricating the spacing glass plate 34 Is preferably the same as that for fabricating the anode substrate 31 and the cathode substrate 41. The thickness of the spacing glass plate 34 depends on the space244 between the anode plate 10 and the cathode plate 20. In this embodiment, the thickness of the spacing glass plate 34 is about 0.5 mm to about 1.5 mm, fir example. A plurality of through holes 341 are toned extending through the spacing glass plate 34. The through holes 341 are aligned with the apertures 54 of the mesh 5. As shown in F*igure* 6, larger through holes 341 may be formed to cover the range of the apertures 54 of two or more than two sets of anode and cathode units. The spacing glass plate 34 also includes an invalid region 342 along a periphery thereof. Markings 343 can be formed on the invalid region 342 to aid in alignment of the mesh 5 and the anode plate 10. Isolation walls 35 can also be formed between the mesh 5 and the anode substrate 31 by screen printing, such that a specific space can be maintained to the advantage of air conducting channel during package.

An isolation wall or a spacer 44 is installed between the cathode substrate 41 and the gate layer 53 to provide air conducting channel. In this embodiment, the thickness of the isolation wall 44 is about 10 μm to about 150 μm, for example. As shown, the isolation wall 44 is so positioned that the electron emission channel between the anode unit and the cathode unit will not be blocked thereby.

Figure 7:
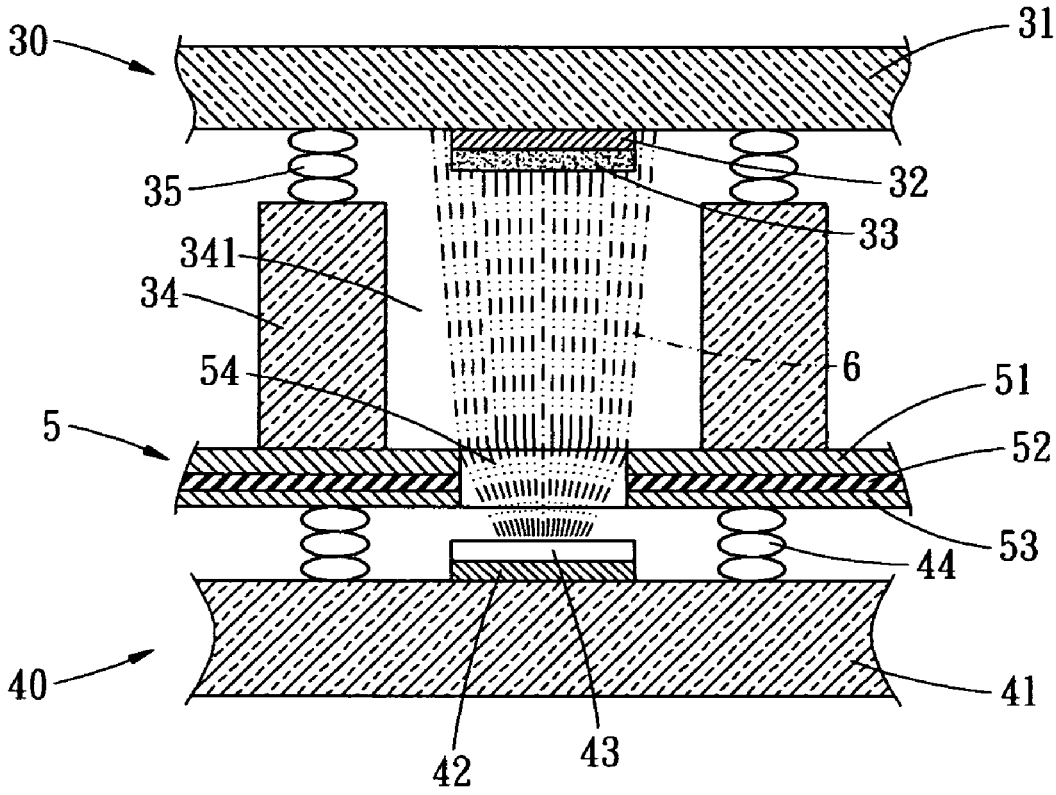
FIG. 7 shows the emission path of the electron beam generated in the field-emission display provided by the present invention.

The path of electron beam 6 is illustrated in FIG. 7. As shown, when the gate layer 53 drains electrons from the electron emission source layer 43, the electron beam 6 is formed to project towards the phosphor layer 33 of the anode. A drain voltage lower than that of the gate layer 53 is applied to the converging electrode layer 51, such that when the cross section of the electron beam 6 traveling through the converging electrode layer 51 is converged. Therefore, the electron beam 6 impinges on the phosphor layer 33 at a predetermined position.

The method of fabricating the mesh 5 includes selecting a metal conductive plate that has a thermal expansion coefficient similar to that of the anode substrate 31 and the cathode substrate 41. For example, an iron, nickel and carbon composite plate with a thickness of about 150 μm and a thermal expansion coefficient of about $82\times10^{-7}/°$ to about $86\times10^{-7}/°$ can be used as the metal conductive plate to prevent crack during vacuum package process due to thermal expansion difference. Laser or photolithography and etching process can be used for forming the apertures 54 through the metal conductive plate, such that the converging electrode layer 51 is formed. An insulation layer 52 is patterned or printed on one side of the converging electrode layer 51. For example, the glass coating paste DG001 produced by DuPond can be used to print the insulation layer 52 on the converging electrode layer 51. The thickness of the insulation layer 52 is preferably controlled between 10 and 100 μm. A conductive layer is then formed on the exposed side of the insulation layer 52 to serve as the gate layer 53. In this embodiment, silver conductive paste DC206 produced by DuPond can be used to print the gate layer 53 with a thickness controlled between 4 to 10 μm. Therefore, the mesh 5 is fabricated by independent process and applied to the display subsequently.

Figure 8:
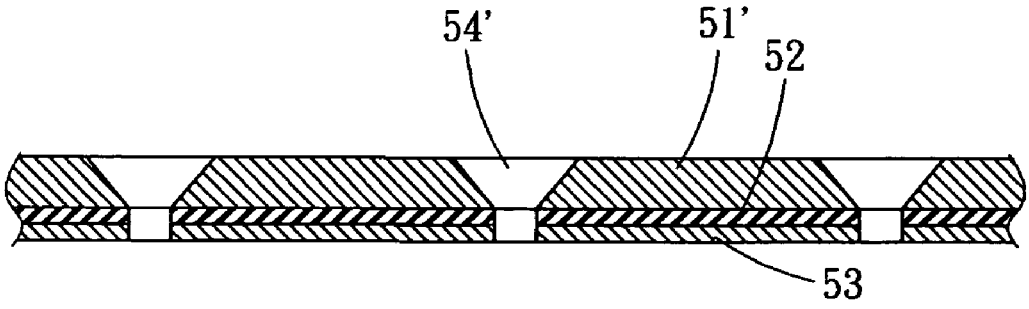
FIG. 8 shows the apertures of the converging electrode layer.
Figure 9:
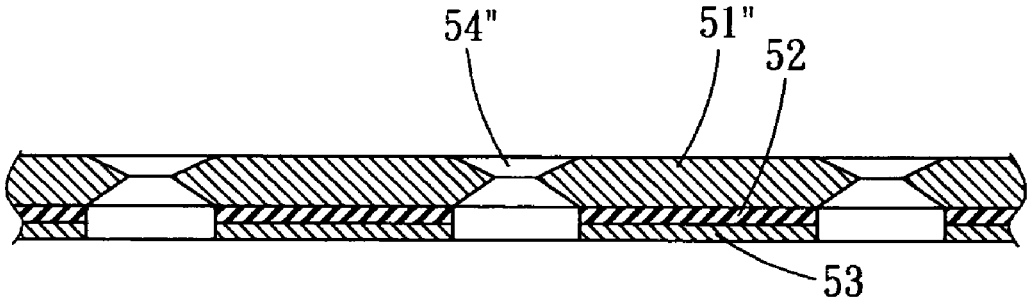
FIG. 9 shows another embodiment of the apertures.

The apertures 54 can be configured with various shapes to obtain specific effect, for example, the inverse conical apertures 54' as shown in FIG. 8 and the sandglass apertures 54" as shown in FIG. 9.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A tetraode field emission display, comprising:

an anode plate, including a phosphor layer formed thereon;

a cathode plate, including an electron emission source layer aligned with the phosphor layer;

a mesh, including a gate layer facing the electron emission source, a converging electrode plate facing the phosphor layer, an insulation layer sandwiched between the gate layer and the converging electrode layer, and a plurality of apertures extending therethrough; and a spacing glass plate extending between the anode plate and the converging electrode plate and having a plurality of through holes formed to be aligned with the apertures.

2. The display of claim 1, further comprising an isolation wall or a spacer extending between the gate layer and the cathode plate.

3. The display of claim 2, wherein the isolation wall is configured between the apertures.

4. The display of claim 1, wherein larger through holes are formed to have each through hole cover more than one aperture.

5. The display of claim 1, wherein the mesh further comprises an invalid region along a periphery of the converging electrode layer, and the invalid region includes a plurality of markings for alignment.

6. The display of claim 1, wherein the apertures have inverse conical shapes.

7. The display of claim 6, wherein flue apertures opening at the gate layer with a gauge larger than a diagonal length of the electron emission source layer.

8. The display of claim 1, wherein the apertures have sandglass shapes.

9. The display of claim 8, wherein the apertures opening at the gate layer with a gauge larger than a diagonal length of the electron emission source layer.

10. The display of claim 1, wherein the converging electrode layer has a potential lower than that of a drain potential applied to the gate layer.

11. The display of claim 1, further comprising an isolation wall extending between the spacing glass plate and the anode plate.

12. The display of claim 1, wherein the spacing glass plate further comprises an invalid region along a periphery thereof, and the invalid region includes a plurality of markings for alignment.

13. A tetraode field emission display, comprising:

an anode substrate on which a plurality of anode units is formed, each of the anode units includes an anode conductive layer and a phosphor layer formed on the anode conductive layer;

a cathode substrate on which a plurality of cathode units is formed, each of the cathode units includes a cathode conductive layer and an electron emission source layer formed on the cathode conductive layer;

a mesh extending between the anode substrate and the cathode substrate, wherein the mesh includes a gate layer facing the cathode unit and a converging electrode plate facing the anode unit, and the mesh includes a plurality of apertures aligned with respective sets of anode and cathode units; and a spacing glass plate extending between the anode plate and the converging electrode plate and having a plurality of through holes formed to be aligned with the apertures.

14. The display of claim 13, wherein the mesh further comprises an insulation layer sandwiched between the gate layer and the converging electrode plate.

15. The dsplay of claim 13, wherein the mesh is fabricated from a material with a thermal expansion coefficient substantially the same as that of the anode substrate and the cathode substrate.

16. The display of claim 13, wherein the apertures opening at the gate layer with a diameter no smaller than a diagonal extent of the electron emission source layer.

17. The display of claim 13, wherein larger through holes are formed to have each through hole cover the range of the apertures of two or more sets of anode and cathode units.

* * * * *